US005407635A

United States Patent [19]

Iseda et al.

[11] Patent Number: 5,407,635

[45] Date of Patent: Apr. 18, 1995

[54] LOW-CHROMIUM FERRITIC HEAT-RESISTANT STEEL WITH IMPROVED TOUGHNESS AND CREEP STRENGTH

[75] Inventors: Atsuro Iseda, Kobe; Yoshiatsu Sawaragi, Nishinomiya; Fujimitsu Masuyama, Nagasaki; Tomomitsu Yokoyama, Tokyo, all of Japan

[73] Assignees: Sumitomo Metal Industries, Ltd., Osaka; Mitsubishi Jukogyo Kabushiki Kaisha, Chiyoda, both of Japan

[21] Appl. No.: 30,542

[22] Filed: Mar. 12, 1993

[30] Foreign Application Priority Data

Mar. 12, 1992 [JP] Japan ..... 4-053765
Mar. 4, 1993 [JP] Japan ..... 5-043993

[51] Int. Cl.[6] ..... C22C 38/26; C22C 38/28

[52] U.S. Cl. ..... 420/110; 420/111; 420/106; 420/109

[58] Field of Search ..... 420/106, 110, 109, 111; 148/333, 334

[56] References Cited

U.S. PATENT DOCUMENTS 3,600,161 8/1971 Inouye et al. .
5,084,238 1/1992 Masuyama et al. ..... 148/334
5,211,909 5/1993 Iseda et al. ..... 420/106

FOREIGN PATENT DOCUMENTS

0411515A1 2/1991 European Pat. Off. .
57-131349 8/1982 Japan .
57-131350 8/1982 Japan .
62-54062 3/1987 Japan .
63-18038 1/1988 Japan .
63-62848 3/1988 Japan .
64-68451 3/1989 Japan .
1-29853 6/1989 Japan .
2-217438 8/1990 Japan .
2-217439 8/1990 Japan .
3-64428 3/1991 Japan .

*Primary Examiner*—Deborah Yee
*Attorney, Agent, or Firm*—Burns, Doane, Swecker & Mathis

[57] ABSTRACT

A low-Cr ferritic steel with improved toughness as well as creep strength is disclosed, which consists essentially of, by weight %:

C: 0.03–0.12%, Si: 0.70% or less, Mn: 0.10–1.50%,
Ni: 2.0% or less, Cr: 1.50–3.50%, W: 1.0–3.0%,
V: 0.10–0.35%, Nb: 0.01–0.10%,
B: 0.00010–0.020%, N: 0.005% or less,
Al: 0.005% or less,
Ti: not less than 0.001% but less than 0.05%,
Cu: 0.10–2.50%,
at least one of La, Ce, Y, Ca, Zr, Ta each in an amount of 0–0.20%, and Mg in an amount of 0–0.05%,
Mo in an amount of 0–0.40%, and
a balance of Fe and incidental impurities including P: not more than 0.030% and S: not more than 0.015%.

24 Claims, 3 Drawing Sheets

LOW-CHROMIUM FERRITIC HEAT-RESISTANT STEEL WITH IMPROVED TOUGHNESS AND CREEP STRENGTH

BACKGROUND OF THE INVENTION

The present invention relates to a low-chromium ferritic heat-resistant steel which exhibits a high creep strength at a temperature of 550° C. or higher and excellent low temperature toughness at room temperature or lower. The steels of the present invention are particularly useful in making heat exchange pipes, piping, heat resistant valves, and connecting joints which are produced through casting and forging, four example, in the boiler-making industry, the chemical industry, and the atomic power industry.

Conventionally, in the manufacture of heat-resistant, pressure-resistant members which are mainly used in such industrial fields as mentioned above, austenitic stainless steels, high-Cr ferritic steels (Cr content of 9–12%), low-Cr Mo-containing ferritic steels (Cr content of 3.5% or smaller), or carbon steels have been used. Among these, suitable steel is selected in view of the service temperature and pressure as well as the circumstances under which the member is to be used. Economy is also important. For example, low-Cr-Mo system ferritic steels with a Cr content of 3.5% are characterized in that they are highly resistant to oxidation and corrosion and exhibit an excellent high temperature strength in comparison with carbon steels which do not contain Cr. In comparison with austenitic stainless steels, this Cr-containing steel is also inexpensive, it is free from stress corrosion cracking, and it has a small thermal linear expansion coefficient. In addition, in comparison with high-Cr ferritic steels, this low Cr-containing steel is less expensive and is superior with respect to toughness, thermal conductivity, and weldability.

Typical examples of low Cr-containing steel are JIS SFBA 24 (2¼Cr-1Mo Steels), STBA 22, and STBA 20, which are collectively referred to as Cr-Mo steels.

Precipitation-hardenable elements, such as V, Nb, Ti, Ta, and B may be added to Cr-Mo steels. See Japanese.Unexamined Laid-Open Patent Specification No. 57-131349/1982, No. 57-131350/1982, No. 62-54062/1987, No. 63-62848/1988, No. 6468451/1989, No. 63-18038/1988, No. 3-64428/1991, and No. 3-87332/1991, and Japanese Patent Publication No. 1-29853/1989.

For use in making turbines, 1Cr-1Mo-0.25V steels are well . known, and for use in constructing fast breeder reactors, 2¼Cr-1Mo-Nb steels are well known.

However, the above-mentioned low Cr-steels are inferior to high Cr ferritic steels and austenitic stainless steels with respect to their resistance to high temperature oxidation and corrosion, and have a much lower strength at high temperatures. Thus, they have troubles if used at a temperature higher than 550° C.

Japanese Unexamined Laid-Open Patent Specifications NO. 2-217438/1990 and No. 2-217439/1990 propose low Cr heat-resistant steels which exhibit improved resistance to high temperature oxidation and corrosion, have excellent high temperature strength, and can be used in place of high-Cr ferritic steels and austenitic stainless steels.

Since the resistance of a steel to oxidation and to corrosion at high temperatures mainly depends on the Cr content of the steel, it is effective to increase the Cr content order to improve such properties. However, the larger the Cr content the lower the thermal conductivity, toughness, weldability, and economy. The invention disclosed in the above-mentioned Japanese Unexamined Laid-Open Patent Specification No. 2-217439/1990 is directed to steels having an oxidation resistance improved by the addition of Cu without increasing the Cr content.

On the other hand, the high temperature strength of a material is critical when the material is used to form a high pressure-resistant member. It is desirable that the high temperature strength always be great regardless of service temperatures. This is because in heat and pressure-resistant steel pipes, such as those used in boilers and in tubes or containers for the chemical and atomic power industries, the wall thickness of a pipe or tube or container is determined by its high temperature strength.

In addition, toughness is critical for pressure-resistant piping, especially when welding is employed in connecting piping. This is because welds are sometimes more brittle than the base material due to inhomogeneities in structure. If the toughness of a material is substantially degraded, failure during pressure testing and fracture during construction or repair of the piping or structure might occur, resulting in less reliability of the structure.

Thus, the following advantages can be obtained when the high temperature strength as well as toughness of low Cr ferritic steels have been improved substantially:

1) In rather mild corrosive conditions at high temperatures, less expensive low-Cr ferritic steels can be used instead of austenitic stainless steels or high-Cr ferritic steels which have conventionally been used in order to ensure high temperature strength.
2) It will be possible to further reduce the wall thickness, resulting in an improvement in thermal conductivity. Thus, the thermal efficiency of equipment can be improved and thermal fatigue of the equipment, which occurs when the equipment is started and shut down, can also be relieved.
3) It is also possible to make the equipment compact and to lower the manufacturing costs due to the lightening of structural elements.

Thus, it is apparent that low-Cr ferritic steels with high strength can result in many practical advantages. However, conventional low-Cr steels with high strength have poor toughness.

For example, Cr-Mo steels, such as JIS STBA 22 and JIS STBA 24, which utilize solution hardening of Mo and precipitation hardening of fine carbides of Cr, Fe, and Mo do not exhibit a higher level of high temperature strength, since the contribution of solution hardening of Mo to an increase in high temperature strength is small and the precipitation hardening caused by the carbides is not so great as expected because of a rapid coarsening of the carbides. In order to increase high temperature strength, therefore, it is advisable to increase the Mo content. However, upon increasing the Mo content, it is inevitable that toughness, formability, and weldability are degraded greatly.

On the other hand, the addition of such precipitation hardening elements as V, Nb, Ti, and B is effective to improve the strength of steel. However, in this case, too, the steel in which carbides of these elements are precipitated in a ferritic matrix exhibits a marked degradation in toughness. Weldability is also deteriorated greatly.

SUMMARY OF THE INVENTION

An object of the present invention is to provide a low-Cr ferritic steel the Cr content of which is 3.5% or smaller and which exhibits improvements in not only high temperature strength but toughness.

Another object of the present invention is to provide a ferritic steel the Cr content of which is 3.5% or smaller and which exhibits not only improved creep strength at a temperature of 550°-625° C., a usual service temperature for boilers, but also toughness, formability and weldability which are the same or greater than those of conventional low-alloy steels.

Still another object of the present invention is to provide a ferritic steel the Cr content of which is 3.5% or smaller and which can be used in place of austenitic stainless steels and high-Cr ferritic steels in an area where the use of low-Cr ferritic steels is restricted due to their inadequate properties including high temperature strength, toughness, formability, and weldability. According to the present invention a low-Cr ferritic steel with improved toughness as well as creep strength is provided, the composition of which is, by weight %:

C : 0.03–0.12%, Si: 0.70% or less, Mn: 0.10–1.50%,
Ni: 2.0% or less, Cr: 1.50–3.50%, W: 1.0–3.0%,
V: 0.10–0.35%, Nb: 0.01–0.10%,
B: 0.00010–0.020%, N: 0.005% or less,
Al: 0.005% or less,
Ti: not less than 0.001 but less than 0.05%,
Cu: 0.10–2.50%,
optionally at least one element from the following (i)–(ii):
(i) La, Ce, Y, Ca, Zr, Ta each in an amount of 0.01–0.20%, and Mg in an amount of 0.0005–0.05%, and
(ii) Mo in an amount of 0.01–0.40%.

DESCRIPTION OF THE PREFERRED EMBODIMENTS

Figure 1:
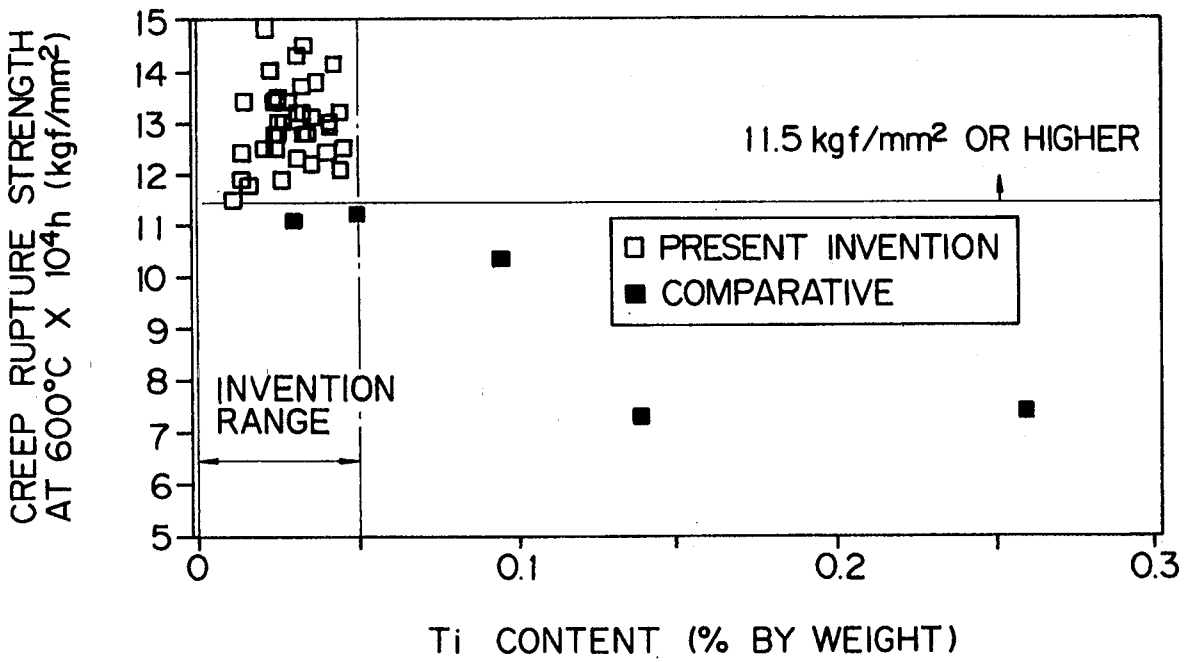
FIG. 1 is a graph showing the relationship between the Ti content and creep rupture strength at 600° C.$\times 10^4$ h.

The present invention is characterized in that the above-described elements are incorporated in suitable amounts. The combination of these elements can result in great improvements in toughness as well as creep strength.

In particular, the features of the present invention can be summarized as follows.

(1) Since the addition of nitrogen lowers creep strength after a long time, the content of nitrogen is restricted to 0.0050% or less, preferably to less than 0.0050%, and a very small amount of Ti is added to fix nitrogen as TiN. Furthermore, the addition of a very small amount of B can improve the creep strength due to an excellent synergistic effect of the B addition with the reduction in the nitrogen content. Such a synergistic effect can be further strengthened when the Al content is reduced to less than 0.005%.

(2) The addition of a small amount of Ti is effective for further improving toughness of welds. This effect can be further increased by the addition of Cu and W.

(3) In order to further improve the resistance to oxidation and corrosion, the addition of Cu is essential. As a precipitation hardening element, V and Nb are added each in a restricted amount. Since W is more effective than Mo as a precipitation hardening element, W rather than Mo is essential to the present invention.

The reasons for restricting the steel composition of the present invention as in the above will be explained in detail. Carbon:

Carbon will combine with Cr, Fe, W, V, Nb, and Ti, and Mo, when added, to form carbides thereof, contributing to an increase in high temperature strength. In addition, since carbon itself is an austenite-former, the presence of carbon in steel is critical for forming a martensite, bainite, or pearlite phase.

When the carbon content is smaller than 0.03%, the amount of carbides precipitated is smaller than that required to produce sufficient strength. In addition, excess formation of a δ-phase is inevitable, resulting in a deterioration in toughness. On the other hand, when the carbon content is over 0.12%, the excess amount of precipitated carbides makes the steel harder with a degradation in formability as well as weldability. Thus, the carbon content of the present invention is defined as 0.03–0.12% and preferably as 0.05–0.08%.

Si

Si is added as a deoxidizer to improve the resistance of steel to steam oxidation. When the Si content is over 0.70%, the toughness as well as formability are degraded with a decrease in high temperature strength. In particular, embrittlement after tempering is accelerated for a thick-wall structural member. Thus, the Si content is defined as 0.70% or less.

Mn

The addition of Mn is effective for improving hot workability and for achieving satisfactory high temperature strength regardless of manufacturing conditions for a wide range of the alloy composition. When Mn in an amount of less than 0.1% is added, it is not effective. On the other hand, when the Mn content is over 1.50%, the resulting steel becomes hard, and formability as well as weldability are impaired. In addition, like Si, Mn makes the steel sensitive to embrittlement after tempering. Thus, the upper limit of the Mn content is restricted to 1.50%.

Ni:

Ni is an austenite former, and the addition of Ni is effective for improving toughness. In view of the effectiveness of Ni addition to reduce hot cracking of Cu-containing steels, it is desirable that Ni is added in an amount equal to or ¼–½ of the Cu content, i.e., Ni(%)=¼Cu(%) or Ni(%)=(¼–½)xCu(%). When Ni is added in an amount of over 2.0%, the high temperature creep strength of the resulting steel is degraded. From a cost viewpoint, excess addition of Ni is to be avoided. Thus, according to the present invention the Ni content is restricted to 2.0% or less.

Cr

Cr is essential to improve the resistance to oxidation as well as the resistance to corrosion at high temperatures for a low-Cr ferritic steel. One of the purposes of the present invention is to provide a heat-resistant steel which can exhibit a satisfactory level of creep strength at such high temperatures as 550°–625° C. Another purpose is to provide a heat resistant steel with improved corrosion resistance. Thus, for improving the resistance to oxidation and corrosion, it is desirable that the Cr content be restricted to not lower than 1.50% from a practical viewpoint. On the other hand, an excess amount of Cr adversely affects the above-mentioned high temperature properties which a low-Cr ferritic steel should have, so the upper limit of Cr is restricted to 3.50%. Furthermore, when the Cr content is over 3.50%, the toughness, weldability and thermal conductivity are degraded, and material costs increase.

W

Tungsten is effective to promote solution hardening, and tungsten itself precipitates in the form of fine carbides to promote precipitation hardening. Thus, the addition of W is effective to markedly increase the creep strength of steel.

Contrary to the prior art in which Cr-Mo steels have been mainly employed, according to the present invention, tungsten is employed instead of Mo. Since the atomic dimensions of W are larger than those of Mo and the diffusion coefficient of W is smaller than that of Mo, the effectiveness of W at improving the creep strength at a high temperature of 550° C. or higher after a long period of time is greater than that of Mo. Thus, according to the present invention, a W content in an amount of 1.0–3.0% is essential. When the W content is lower than 1.0%, it is not substantially effective. On the other hand, when the W content is over 3.0%, the resulting steel is so much hardened that toughness, formability, and weldability are degraded. A preferred W content is 1.4–1.8%.

V

Vanadium is combined mainly with C to form a fine carbide, VC, the precipitation of which is effective to improve creep strength. However, when the V content is less than 0.10%, it is not sufficiently effective. When the V content is over 0.35%, the creep strength properties are deteriorated, resulting in a degradation in toughness and weldability. Thus, the V content is restricted to 0.10–0.35% in the present invention.

Nb

Niobium, just like vanadium, is combined mainly with C to form a fine carbide, NbC, the precipitation of which is effective to improve creep strength. In particular, since the carbide is stable at a temperature of 625° C. or lower, improvement in creep strength is marked at such high temperatures. However, when the Nb content is less than 0.010%, it is not adequately effective. When the V content is over 0.10%, the steel is hardened, resulting in a degradation in toughness and weldability. Thus, the Nb content is restricted to 0.010–0.10% in the present invention.

Al

Al is added as a deoxidizer. In the prior art Al is added in an amount sufficient to give a sol. Al content of 0.005% or larger, and a thorough deoxidization is achieved. However, according to the present invention the addition of an excess amount of Al is avoided in order not to deteriorate the creep strength and toughness. This is because Al is combined with N to shift the quantitative balance between the contents of B and Ti, causing a change in structure of fine precipitates. Thus, according to the present invention the Al content is restricted to 0.0050% or less, preferably to less than 0.0050%. It is to be noted that deoxidation will be carried out by other elements, such as C, Si, Mn, La, Ce, Y, and Mg, even if such a small amount of Al is added.

B

The addition of a very small amount of B is still effective to disperse and stabilize carbides so that the creep strength at high temperatures and after a long period of time can be improved markedly. Especially, this effect is remarkable when the N content is reduced to a much lower level than the upper limit of N which will be mentioned later. It is to be noted that when the N content is large, B is combined with N to form coarse precipitates, which do not improve high temperature strength.

Thus, according to the present invention, the effectiveness of B can be maximized when the Al content is restricted to a lower level within the range defined in the present invention and the contents of Ti and N are balanced.

When the B content is less than 0.0001%, its effectiveness is very small. When the B content is over 0.020%, formability and weldability are deteriorated markedly and further improvement in creep strength is not expected. Thus, the B content is restricted to 0.0001–0.020%.

Ti

Ti is combined with C and N to form Ti(C,N). According to the present invention a very small amount of Ti is added so as to fix N, since Ti very easily reacts with N. The fixation of N with Ti is very effective to improve the creep strength and toughness of B-containing steels. The toughness is improved by decreasing the amount of N in solid solution. When the Ti content is less than 0.001%, however, it is not adequately effective. On the other hand, when the Ti content is over 0.050%, coarse particles of Ti(C,N) are precipitated, resulting in a marked degradation in strength and toughness. Thus, according to the present invention, the Ti content is restricted to not less than 0.001% but less than 0.050%.

N

As stated above, the presence of nitrogen in solid solution markedly deteriorates toughness and creep strength of the resulting steel. In addition, when nitrogen is combined with V, Nb, and Ti to form coarse precipitates, the toughness will be deteriorated. It is also found that the presence of N makes a bainite, martensite, or pearlite phase unstable at high temperatures. Thus, the N content is restricted to 0.0050% or less, preferably to less than 0.0050%.

Cu

The addition of Cu is effective to increase the steel strength due to improvement in solution hardening as well as precipitation hardening. The addition of Cu is also effective to improve the resistance to oxidation. Furthermore, the presence of Cu can promote formation of a martensite phase with resulting improvement in toughness.

When the Cu content is less than 0.10%, the above-mentioned effect cannot be expected. On the other hand, when the Cu content is over 2.50%, hot workability and ductility will be impaired. Thus, the Cu content of the present invention is restricted to 0.10–2.50% and preferably to 0.20–1.0%.

The balance of the low alloyed steel of the present invention is comprised of Fe and incidental impurities, in which the content of P and S should be reduced to as small a level as possible in order to avoid degradation in toughness and creep limit. The amount of allowable impurities is 0.030% or less for P and 0.015% or less for S.

The low-alloy heat-resistant steel of the present invention optionally may comprise one of the following additives. La, Ce, Y, Ca, Zr, Ta, and Mg:

These elements are added to combine with P, S, and oxygen, which are included in the steel as impurities, so as to change precipitates, i.e., non-metallic inclusions to a better form.

When at least one of La, Ce, Y, Ca, Zr and Ta each in an amount of 0.010% or more is added, toughness, strength, formability and weldability can be improved due to the above-mentioned functions of these elements. When the amount is less than 0.010% for each, they are not substantially effective. On the other hand, when the amount is over 0.20% for each, the amount of inclusions increases, resulting in a decrease in toughness and strength.

The addition of Mg in a small amount is also effective because Mg combines with oxygen and S to improve the toughness and formability of the steel. The addition of Mg is also effective to improve the creep ductility as well as the strength of the steel. When the Mg content is less than 0.0005%, it is not effective. When the Mg content is over 0.050%, however, there is no further improvement expected, and there is a degradation in formability. Thus, the Mg content, if Mg is added, is restricted to 0.00050–0.050%.

Two or more of the elements La, Ce, Y, Ca, Zr, Ta, and Mg may be added, if desirable. In such a case, it is preferable that the total amount of these added elements be restricted to not larger than 0.20%.

Mo

Mo, like W, is effective to promote solution hardening as well as precipitation hardening. Mo is an optional element in the present invention. However, when Mo is added in combination with W, the high temperature strength of the steel can be improved markedly. In addition, when a small amount of Mo is added, it is also effective to improve toughness. The lower limit of Mo addition is 0.010%. When the content of Mo is over 0.40%, no further improvement in high temperature strength can be expected, and toughness and formability are degraded. Thus, when Mo is added, the amount of Mo is restricted to 0.010–0.40%, and preferably to not less than 0.010% and less than 0.10%.

The present invention will be further described in detail on the basis of working examples, which are presented merely for illustrative purposes and are not restrictive of the present invention in any way.

Examples

Steels having the alloy compositions shown in Table 1 were melted in a vacuum melting furnace with a capacity of 150 kg. The molten steels were cast into ingots which were then forged at a temperature of 1150–950° C. to form plates having a thickness of 20 mm.

Steel A corresponded to JIS STBA 22 and Steel B corresponded to JIS STBA 24, which are typical, conventional low-Cr ferritic steels.

Steels C and D were comparative, in which V or Nb was added to 2¼Cr-1Mo steels of the precipitation hardening type. Steel E–Steel I further contained B, N, Ti, or Cu. Steel. H–Steel J contained Mo in combination with W.

Steel K–Steel O were also comparative and had substantially the same alloy composition as 2¼Cr-containing steels of the present invention except for the contents of N and Al.

Steel P–Steel T corresponded to typical 1Cr-containing steels which are disclosed in Japanese Unexamined Laid-Open Patent Specification No. 2-217439/1990.

Steels Nos. 1 through 42 were examples of steels of the present invention.

Normalizing and tempering heat treatments were carried out as follows.

i) For Steels A and B

920° C.×1 h→Air Cooling→720° C.×1 h→Air Cooling ii) For Steels C through T and Steels Nos. 1 through 42

1050° C.×0.5 h→Air Cooling→780° C.×1 h →Air Cooling

Test pieces for a tensile test at room temperature were specimens measuring 6 mm (diameter)×GL 30 mm. The same test pieces were used in the creep rupture test, in which the test was run for at most 15000 hours at 600° C. and the creep rupture strength at 600° C.×$10^4$ h was determined based on the data obtained.

Test pieces for the Charpy impact test were specimens measuring 10×10×50 (mm) with a 2 mm-deep V-shaped notch (JIS No. 4 test piece). Using the Charpy test results, the ductility transition temperature was determined.

Furthermore, weldability tests, i.e., slanting y-shaped restrain weld cracking tests (JIS Z 3158) were conducted so as to determine the preheating temperature at which weld cracking could be prevented.

The test results are summarized in Table 2 and in FIGS. 1 through 5.

Figure 2:
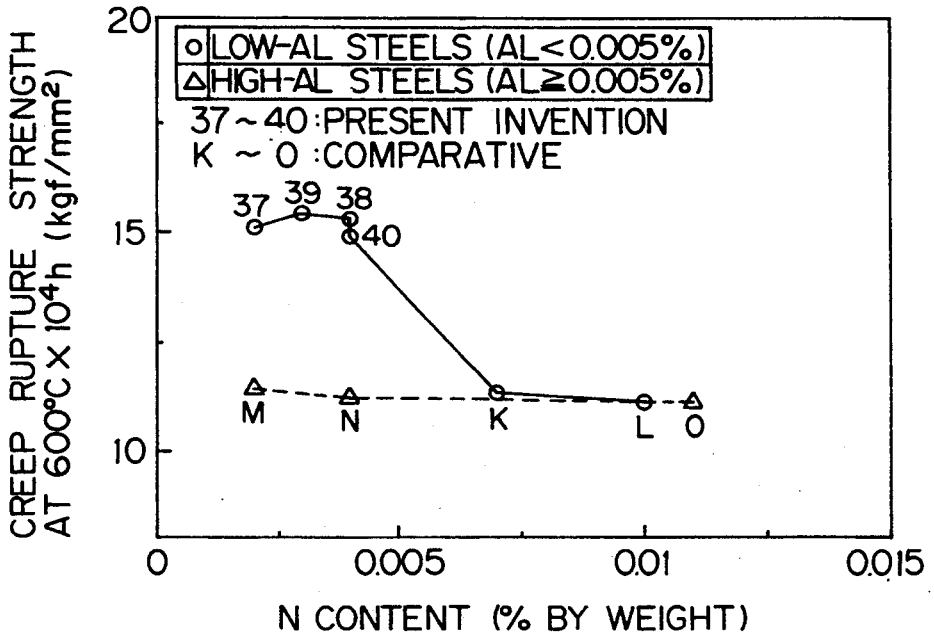
FIG. 2 is a graph showing the relationship between the N content and creep rupture strength at 600° C.$\times 10^4$ h for 2¼Cr-containing steels.
Figure 3:
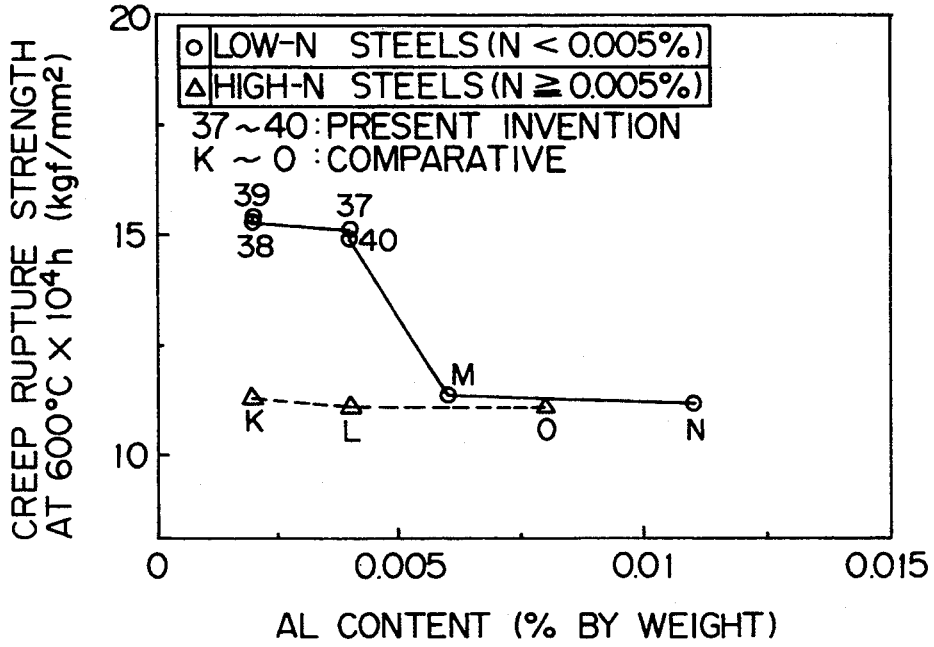
FIG. 3 is a graph showing the relationship between the Al content and creep rupture strength at 600° C.$\times 10^4$ h for 2¼Cr-containing steels.
Figure 4:
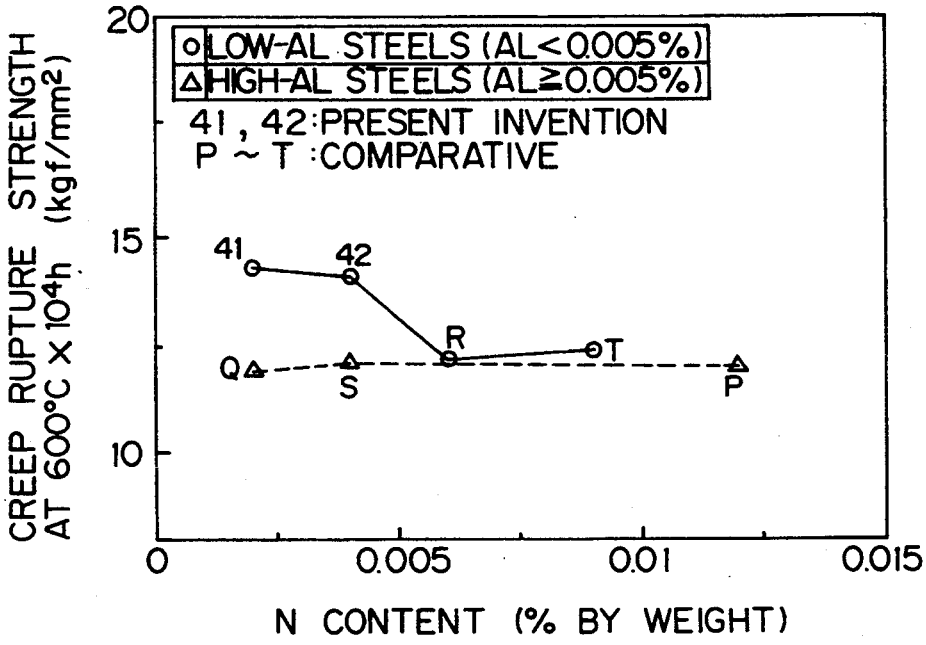
FIG. 4 is a graph showing the relationship between the N content and creep rupture strength at 600° C.$\times 10^4$ h for 1Cr-containing steels.
Figure 5:
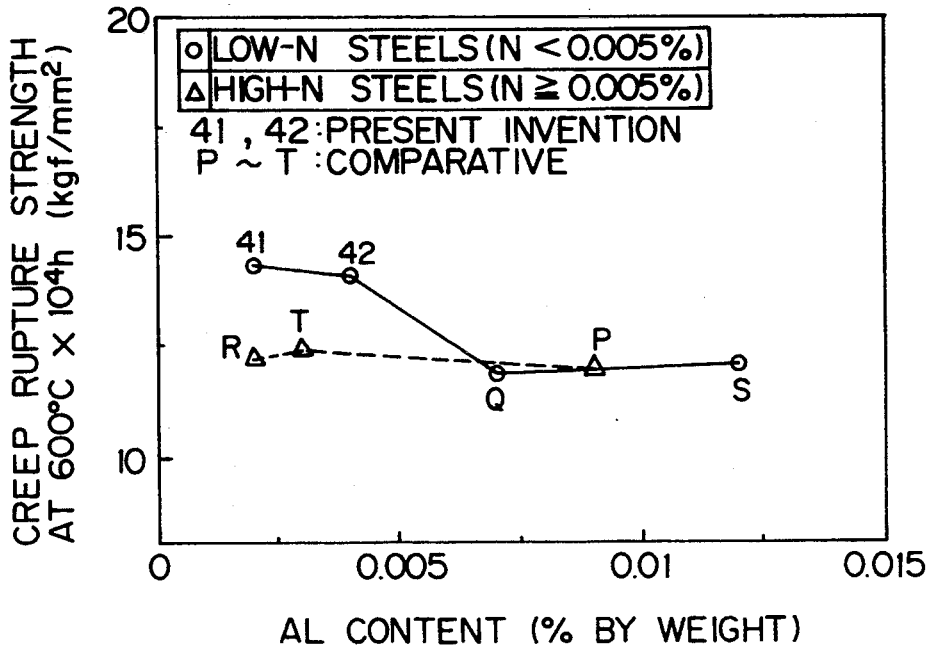
FIG. 5 is a graph showing the relationship between the Al content and creep rupture strength at 600° C.$\times 10^4$ h for 1 Cr-containing steels.

FIG. 1 shows the relationship between the Ti content and creep rupture strength at 600° C×$10^4$ h, FIGS. 2 and 3 show the relationship between the N or Al content and creep rupture strength at 600° C.×$10^4$ h for 2¼Cr-containing steels, and FIGS. 4 and 5 show the relationship between the N or Al content and creep rupture strength at 600° C.×$10^4$ h for 1Cr-containing steels.

As is apparent from the test results shown in Table 2, the steels of the present invention exhibit satisfactory ductility, i.e., a tensile elongation at room temperature of 25% or more. The ductility transition temperature is not higher than −25° C., which means that toughness of the steel of the present invention is satisfactory.

It is also apparent from FIG. 1 that the addition of a small amount of Ti is very effective to give a creep rupture strength of 11 5 kgf/$mm^2$, which is two times larger than those obtained for comparative Steels A and B.

FIGS. 2 through 5 show that steels containing less than 0.005% each of N and Al exhibit markedly improved creep rupture strength. Furthermore, the addition of a very small amount of Ti to such steels containing less than 0.005% each of Al and N is very effective to further stabilize the presence of N, which can promote the effectiveness of W, B and other alloying elements to strengthen the steel.

It is also to be noted that Table 2 indicates that the preheating temperature to avoid the occurrence of weld cracks is 120° C. or lower for the steels of the present invention, which is comparative to that of the comparative steels, of which Steels C through J are more sensitive to weld cracking because they contain excess amounts of N and Ti, in spite of the fact that they contain V and Nb.

TABLE 1

| No. | C | Si | Mn | P | S | Ni | Cr | Mo | W | V | Nb | Al | B | Ti | N | Cu | (wt % Balance: Fe) Others |
|---|---|---|---|---|---|---|---|---|---|---|---|---|---|---|---|---|---|
| | | | | | | | | | Comparative | | | | | | | | |
| A | 0.11 | 0.37 | 0.46 | 0.013 | 0.005 | 0.01 | 1.02 | 0.53 | | | | 0.009 | | | 0.014 | | |
| B | 0.12 | 0.38 | 0.56 | 0.014 | 0.005 | 0.13 | 2.24 | 1.03 | | | | 0.007 | | | 0.016 | | |
| C | 0.13 | 0.20 | 0.51 | 0.012 | 0.004 | 0.13 | 2.20 | 0.98 | | 0.24 | 0.06 | 0.014 | | | 0.007 | | |
| D | 0.13 | 0.33 | 0.55 | 0.025 | 0.003 | 0.23 | 2.14 | 0.99 | | 0.21 | 0.05 | 0.005 | | | 0.017 | | |
| E | 0.09 | 0.21 | 0.56 | 0.021 | 0.002 | 0.35 | 1.95 | 0.98 | | 0.23 | 0.06 | 0.025 | 0.0032 | 0.050 | 0.006 | | |
| F | 0.10 | 0.05 | 0.62 | 0.015 | 0.005 | 0.06 | 2.01 | 1.05 | | 0.22 | 0.05 | 0.005 | 0.0025 | 0.095 | 0.021 | | |
| G | 0.11 | 0.21 | 0.56 | 0.013 | 0.003 | 0.21 | 2.21 | 1.03 | | 0.15 | 0.03 | 0.030 | 0.0025 | 0.030 | 0.003 | 1.02 | |
| H | 0.10 | 0.15 | 0.45 | 0.017 | 0.004 | 0.21 | 2.14 | 0.20 | 2.01 | 0.23 | 0.04 | 0.040 | | | 0.024 | 0.56 | |
| I | 0.12 | 0.26 | 0.47 | 0.025 | 0.005 | 0.04 | 2.13 | 0.21 | 1.95 | 0.20 | 0.03 | 0.014 | 0.0032 | 0.140 | 0.002 | 1.04 | |
| J | 0.08 | 0.34 | 0.46 | 0.026 | 0.002 | 0.32 | 2.21 | 0.21 | 2.02 | 0.24 | 0.05 | 0.016 | 0.0015 | 0.260 | 0.003 | | |
| K | 0.08 | 0.20 | 0.46 | 0.014 | 0.002 | 0.05 | 2.26 | 0.08 | 1.57 | 0.27 | 0.05 | 0.002 | 0.0042 | 0.032 | 0.007 | 0.25 | |
| L | 0.08 | 0.21 | 0.47 | 0.012 | 0.002 | 0.06 | 2.23 | 0.08 | 1.53 | 0.27 | 0.05 | 0.004 | 0.0038 | 0.027 | 0.010 | 0.23 | |
| M | 0.09 | 0.22 | 0.47 | 0.013 | 0.003 | 0.06 | 2.23 | 0.09 | 1.53 | 0.29 | 0.03 | 0.006 | 0.0039 | 0.031 | 0.002 | 0.23 | |
| N | 0.09 | 0.19 | 0.45 | 0.011 | 0.003 | 0.04 | 2.26 | 0.09 | 1.56 | 0.29 | 0.04 | 0.011 | 0.0041 | 0.028 | 0.004 | 0.22 | |
| O | 0.09 | 0.24 | 0.62 | 0.005 | 0.003 | 0.04 | 2.26 | 0.32 | 1.57 | 0.29 | 0.06 | 0.008 | 0.0041 | 0.043 | 0.011 | 0.23 | |
| P | 0.11 | 0.37 | 0.55 | 0.012 | 0.004 | 0.11 | 1.05 | 0.12 | 2.02 | 0.22 | 0.05 | 0.009 | 0.0050 | | 0.012 | 1.02 | Mg: 0.003, La: 0.12, Ce: 0.05 |
| Q | 0.10 | 0.35 | 0.54 | 0.011 | 0.003 | 0.10 | 1.00 | 0.10 | 2.01 | 0.23 | 0.06 | 0.008 | 0.0049 | 0.029 | 0.010 | 0.98 | Mg: 0.002, La: 0.13, Ce: 0.05 |
| R | 0.10 | 0.35 | 0.54 | 0.010 | 0.003 | 0.09 | 0.99 | 0.11 | 1.98 | 0.23 | 0.04 | 0.008 | 0.0048 | 0.030 | 0.009 | 1.03 | Mg: 0.003, La: 0.11, Ce: 0.06 |
| S | 0.09 | 0.37 | 0.53 | 0.012 | 0.004 | 0.08 | 1.03 | 0.10 | 1.99 | 0.24 | 0.05 | 0.007 | 0.0049 | | 0.011 | 1.01 | Mg: 0.004, La: 0.12, Ce: 0.03 |
| T | 0.11 | 0.37 | 0.55 | 0.011 | 0.004 | 0.09 | 1.01 | 0.12 | 2.01 | 0.23 | 0.05 | 0.009 | 0.0050 | 0.028 | 0.011 | 0.99 | Mg: 0.003, La: 0.10, Ce: 0.04 |
| | | | | | | | | | Invention | | | | | | | | |
| 1 | 0.11 | 0.24 | 0.43 | 0.022 | 0.001 | 0.75 | 2.00 | | 1.10 | 0.15 | 0.02 | 0.004 | 0.0012 | 0.012 | 0.004 | 2.43 | |
| 2 | 0.10 | 0.35 | 0.55 | 0.023 | 0.002 | 0.32 | 2.12 | | 1.52 | 0.13 | 0.06 | 0.003 | 0.0010 | 0.032 | 0.003 | 0.32 | |
| 3 | 0.11 | 0.36 | 0.56 | 0.015 | 0.002 | 0.32 | 2.23 | 0.09 | 2.03 | 0.17 | 0.08 | 0.002 | 0.0020 | 0.045 | 0.003 | 0.75 | |
| 4 | 0.09 | 0.24 | 0.62 | 0.005 | 0.003 | 0.10 | 2.10 | 0.32 | 2.32 | 0.23 | 0.09 | 0.004 | 0.0032 | 0.043 | 0.003 | 0.23 | |
| 5 | 0.08 | 0.21 | 0.57 | 0.030 | 0.001 | 0.10 | 1.93 | | 2.89 | 0.24 | 0.04 | 0.003 | 0.0035 | 0.042 | 0.002 | 0.22 | |
| 6 | 0.06 | 0.05 | 0.54 | 0.022 | 0.001 | 0.25 | 1.60 | | 2.03 | 0.26 | 0.06 | 0.001 | 0.0032 | 0.046 | 0.004 | 0.56 | La: 0.05 |
| 7 | 0.04 | 0.03 | 0.53 | 0.016 | 0.003 | 0.06 | 1.85 | | 1.53 | 0.24 | 0.04 | 0.003 | 0.0020 | 0.032 | 0.003 | 0.13 | Mg: 0.002 |
| 8 | 0.07 | 0.02 | 0.54 | 0.030 | 0.002 | 0.04 | 1.69 | | 1.75 | 0.22 | 0.03 | 0.004 | 0.0040 | 0.034 | 0.004 | 0.22 | Ce: 0.02 |
| 9 | 0.05 | 0.05 | 0.55 | 0.008 | 0.005 | 0.23 | 2.23 | | 1.89 | 0.21 | 0.05 | 0.004 | 0.0035 | 0.025 | 0.004 | 0.89 | Ta: 0.04 |
| 10 | 0.06 | 0.23 | 0.50 | 0.009 | 0.002 | 0.28 | 3.45 | 0.05 | 1.95 | 0.20 | 0.06 | 0.003 | 0.0021 | 0.026 | 0.003 | 0.75 | Ca: 0.04 |
| 11 | 0.07 | 0.32 | 0.56 | 0.015 | 0.001 | 0.32 | 3.41 | | 2.13 | 0.19 | 0.04 | 0.004 | 0.0016 | 0.027 | 0.004 | 0.62 | Y: 0.02 |
| 12 | 0.06 | 0.42 | 0.57 | 0.010 | 0.002 | 1.55 | 3.21 | | 1.57 | 0.20 | 0.06 | 0.004 | 0.0040 | 0.015 | 0.003 | 1.53 | Zr: 0.01 |
| 13 | 0.07 | 0.32 | 0.58 | 0.020 | 0.001 | 1.75 | 3.00 | | 1.60 | 0.23 | 0.05 | 0.003 | 0.0032 | 0.016 | 0.002 | 2.42 | La: 0.02, Mg: 0.001 |
| 14 | 0.04 | 0.52 | 0.56 | 0.013 | 0.003 | 0.96 | 1.96 | 0.04 | 2.00 | 0.22 | 0.05 | 0.002 | 0.0036 | 0.026 | 0.004 | 1.03 | Ca: 0.01, Y: 0.03 |
| 15 | 0.05 | 0.24 | 0.51 | 0.014 | 0.005 | 0.32 | 2.45 | 0.07 | 2.30 | 0.21 | 0.06 | 0.001 | 0.0024 | 0.034 | 0.003 | 0.52 | Ta: 0.04, Ce: 0.01 |
| 16 | 0.07 | 0.32 | 0.53 | 0.013 | 0.002 | 0.42 | 2.56 | | 1.68 | 0.27 | 0.04 | 0.002 | 0.0031 | 0.038 | 0.004 | 0.45 | Ca: 0.03, Zr: 0.02 |
| 17 | 0.08 | 0.30 | 0.57 | 0.012 | 0.004 | 0.32 | 2.23 | | 1.63 | 0.22 | 0.03 | 0.003 | 0.0029 | 0.025 | 0.003 | 0.46 | Ca: 0.03, Ce: 0.01 |
| 18 | 0.09 | 0.21 | 0.53 | 0.014 | 0.003 | 0.05 | 2.21 | | 1.68 | 0.20 | 0.03 | 0.002 | 0.0027 | 0.036 | 0.002 | 0.20 | Ta: 0.02, Zr: 0.04 |
| 19 | 0.08 | 0.26 | 0.57 | 0.021 | 0.005 | 0.41 | 2.28 | | 1.67 | 0.18 | 0.02 | 0.003 | 0.0018 | 0.024 | 0.003 | 0.82 | Y: 0.02, Mg: 0.02 |
| 20 | 0.07 | 0.37 | 0.61 | 0.020 | 0.003 | 0.23 | 2.80 | | 1.75 | 0.17 | 0.09 | 0.004 | 0.0014 | 0.028 | 0.004 | 0.23 | Zr: 0.01, Y: 0.01 |
| 21 | 0.06 | 0.18 | 0.63 | 0.006 | 0.002 | 0.22 | 1.95 | | 1.68 | 0.21 | 0.04 | 0.003 | 0.0022 | 0.029 | 0.003 | 0.31 | La: 0.02, Ce: 0.01 |
| 22 | 0.04 | 0.15 | 0.50 | 0.004 | 0.002 | 0.10 | 1.63 | | 1.63 | 0.22 | 0.07 | 0.002 | 0.0011 | 0.034 | 0.003 | 0.30 | La: 0.04, Ta: 0.03 |
| 23 | 0.06 | 0.35 | 0.34 | 0.026 | 0.001 | 0.20 | 2.20 | | 1.58 | 0.26 | 0.08 | 0.004 | 0.0019 | 0.042 | 0.002 | 0.42 | Y: 0.01, La: 0.02, Mg: 0.001 |
| 24 | 0.07 | 0.31 | 0.57 | 0.022 | 0.004 | 0.32 | 2.01 | 0.08 | 1.24 | 0.24 | 0.07 | 0.004 | 0.0025 | 0.025 | 0.004 | 0.50 | Ca: 0.02, Ta: 0.04, Mg: 0.005 |
| 25 | 0.06 | 0.29 | 0.45 | 0.012 | 0.003 | 0.14 | 2.31 | | 1.36 | 0.21 | 0.06 | 0.003 | 0.0024 | 0.036 | 0.003 | 0.36 | Ce: 0.01, Y: 0.03, Ca: 0.01 |
| 26 | 0.08 | 0.17 | 0.46 | 0.009 | 0.003 | 0.10 | 2.05 | | 1.57 | 0.23 | 0.05 | 0.002 | 0.0025 | 0.045 | 0.002 | 0.20 | Zr: 0.04, Ta: 0.02, La: 0.01 |
| 27 | 0.07 | 0.10 | 0.43 | 0.008 | 0.005 | 0.20 | 2.04 | | 1.92 | 0.21 | 0.09 | 0.002 | 0.0028 | 0.026 | 0.003 | 0.42 | Y: 0.01, Zr: 0.04, Ce: 0.01 |
| 28 | 0.06 | 0.23 | 0.47 | 0.007 | 0.003 | 0.23 | 2.07 | 0.12 | 1.80 | 0.22 | 0.02 | 0.002 | 0.0018 | 0.033 | 0.004 | 0.43 | Ta: 0.03, Y: 0.01, Mg: 0.002 |
| 29 | 0.08 | 0.21 | 0.46 | 0.012 | 0.004 | 0.28 | 2.21 | | 1.70 | 0.27 | 0.03 | 0.001 | 0.0031 | 0.041 | 0.004 | 0.56 | La: 0.01, Ce: 0.02, Y: 0.02, Ca: 0.02 |
| 30 | 0.07 | 0.22 | 0.50 | 0.011 | 0.004 | 0.37 | 2.23 | | 1.34 | 0.21 | 0.04 | 0.003 | 0.0020 | 0.035 | 0.003 | 0.37 | Zr: 0.01, Ta: 0.02, La: 0.01, Mg: 0.005 |
| 31 | 0.09 | 0.17 | 0.52 | 0.010 | 0.002 | 0.24 | 2.56 | | 1.60 | 0.22 | 0.03 | 0.003 | 0.0024 | 0.022 | 0.004 | 0.42 | Ce: 0.03, Ca: 0.01, Y: 0.02, Zr: 0.02 |
| 32 | 0.11 | 0.11 | 0.55 | 0.003 | 0.003 | 0.22 | 2.54 | | 1.50 | 0.24 | 0.05 | 0.003 | 0.0032 | 0.032 | 0.003 | 0.42 | La: 0.01, Ca: 0.02, Ce: 0.01, Y: 0.01, Zr: 0.01 |
| 33 | 0.11 | 0.16 | 0.57 | 0.021 | 0.001 | 0.10 | 2.53 | | 1.43 | 0.23 | 0.04 | 0.002 | 0.0025 | 0.017 | 0.004 | 0.21 | Ta: 0.02, La: 0.01, Y: 0.01, Ca: 0.01, Mg: 0.001 |

TABLE 1-continued

| No. | C | Si | Mn | P | S | Ni | Cr | Mo | W | V | Nb | Al | B | Ti | N | Cu | (wt % Balance: Fe) Others |
|---|---|---|---|---|---|---|---|---|---|---|---|---|---|---|---|---|---|
| 34 | 0.10 | 0.14 | 0.58 | 0.020 | 0.006 | 0.13 | 2.32 | | 1.18 | 0.22 | 0.06 | 0.003 | 0.0026 | 0.015 | 0.003 | 0.21 | La: 0.01, Ca: 0.01, Ce: 0.02, Y: 0.01, Zr: 0.02, Ta: 0.04 |
| 35 | 0.09 | 0.13 | 0.56 | 0.010 | 0.002 | 0.14 | 2.21 | | 1.47 | 0.21 | 0.06 | 0.004 | 0.0024 | 0.026 | 0.003 | 0.20 | Ca: 0.01, Ce: 0.01, Y: 0.02, Zr: 0.02, Ta: 0.02, Mg: 0.001 |
| 36 | 0.08 | 0.22 | 0.55 | 0.006 | 0.001 | 0.16 | 2.23 | | 1.86 | 0.23 | 0.07 | 0.004 | 0.0026 | 0.022 | 0.004 | 0.36 | La: 0.01, Ca: 0.01, Ce: 0.02, Y: 0.02, Zr: 0.01, Ta: 0.02, Mg: 0.001 |
| 37 | 0.08 | 0.21 | 0.47 | 0.012 | 0.004 | 0.04 | 2.24 | 0.09 | 1.53 | 0.27 | 0.06 | 0.004 | 0.0040 | 0.038 | 0.002 | 0.23 | |
| 38 | 0.09 | 0.21 | 0.49 | 0.012 | 0.005 | 0.05 | 2.24 | 0.07 | 1.60 | 0.29 | 0.06 | 0.002 | 0.0039 | 0.041 | 0.004 | 0.20 | |
| 39 | 0.09 | 0.28 | 0.51 | 0.015 | 0.003 | 0.06 | 2.27 | 0.08 | 1.57 | 0.26 | 0.07 | 0.002 | 0.0039 | 0.029 | 0.003 | 0.21 | |
| 40 | 0.08 | 0.33 | 0.50 | 0.013 | 0.003 | 0.06 | 2.23 | | 1.72 | 0.27 | 0.03 | 0.004 | 0.0041 | 0.027 | 0.004 | 0.24 | |
| 41 | 0.11 | 0.36 | 0.55 | 0.013 | 0.004 | 0.09 | 1.03 | 0.09 | 2.04 | 0.23 | 0.05 | 0.002 | 0.0051 | 0.026 | 0.002 | 1.03 | Mg: 0.003, La: 0.11, Ce: 0.05 |
| 42 | 0.09 | 0.33 | 0.51 | 0.011 | 0.002 | 0.07 | 0.99 | 0.08 | 1.98 | 0.26 | 0.07 | 0.004 | 0.0048 | 0.028 | 0.004 | 0.99 | Mg: 0.005, La: 0.15, Ce: 0.03 |

TABLE 2

| No. | Tensile Test (Room temperature) Tensile Strength (kgf/mm$^2$) | 0.2% Proof Strength (kgf/mm$^2$) | Elongation (%) | Transition Temperature by Charpy Impact Test (°C.) | 600° C. × 10$^4$ h Creep Rupture Strength (kgf/mm$^2$) | Preheating Temperature for Preventing Weld Crack (°C.) |
|---|---|---|---|---|---|---|
| | | | | Comparative | | |
| A | 51.2 | 32.4 | 37 | −35 | 5.6 | 125 |
| B | 56.3 | 39.2 | 32 | −32 | 6.2 | 100 |
| C | 74.3 | 62.4 | 25 | 10 | 8.5 | 250 |
| D | 71.0 | 59.3 | 22 | 0 | 9.3 | 200 |
| E | 68.6 | 56.5 | 23 | 26 | 11.2 | 175 |
| F | 71.2 | 58.2 | 25 | 32 | 10.3 | 225 |
| G | 70.8 | 57.1 | 19 | 27 | 11.1 | 250 |
| H | 72.6 | 59.3 | 21 | 15 | 8.7 | 275 |
| I | 74.1 | 63.0 | 17 | 30 | 7.3 | 250 |
| J | 70.5 | 59.7 | 19 | 35 | 7.4 | 225 |
| K | 67.3 | 57.2 | 27 | −25 | 11.3 | 125 |
| L | 68.2 | 56.8 | 22 | −32 | 11.1 | 125 |
| M | 67.5 | 57.0 | 23 | −30 | 11.4 | 125 |
| N | 68.6 | 57.2 | 22 | −35 | 11.2 | 100 |
| O | 68.3 | 56.9 | 20 | −27 | 11.1 | 100 |
| P | 68.1 | 56.4 | 22 | −35 | 12.0 | 100 |
| Q | 67.5 | 57.2 | 19 | −30 | 11.9 | 100 |
| R | 67.8 | 57.0 | 23 | −33 | 12.2 | 100 |
| S | 68.3 | 55.3 | 18 | −35 | 12.1 | 125 |
| T | 68.5 | 56.5 | 20 | −31 | 12.4 | 125 |
| | | | | Invention | | |
| 1 | 75.0 | 64.2 | 25 | −32 | 11.5 | 125 |
| 2 | 72.1 | 61.0 | 27 | −25 | 12.3 | 100 |
| 3 | 71.5 | 59.1 | 28 | −35 | 13.2 | 100 |
| 4 | 69.7 | 57.3 | 25 | −42 | 14.1 | 75 |
| 5 | 71.2 | 60.3 | 29 | −50 | 13.0 | 75 |
| 6 | 66.8 | 57.3 | 26 | −47 | 12.5 | 100 |
| 7 | 65.8 | 56.4 | 30 | −35 | 14.3 | 75 |
| 8 | 67.5 | 58.9 | 27 | −28 | 12.8 | 75 |
| 9 | 69.4 | 57.5 | 26 | −30 | 12.5 | 75 |
| 10 | 67.2 | 56.0 | 29 | −45 | 13.0 | 100 |
| 11 | 69.1 | 57.3 | 27 | −45 | 11.9 | 100 |
| 12 | 67.6 | 55.4 | 26 | −30 | 12.4 | 75 |
| 13 | 68.3 | 57.2 | 25 | −38 | 13.4 | 100 |
| 14 | 64.9 | 55.0 | 26 | −28 | 12.8 | 100 |
| 15 | 65.8 | 56.2 | 27 | −40 | 14.5 | 100 |
| 16 | 67.4 | 56.3 | 26 | −35 | 13.8 | 75 |
| 17 | 68.3 | 57.3 | 26 | −37 | 13.4 | 75 |
| 18 | 68.1 | 56.5 | 27 | −33 | 12.2 | 75 |
| 19 | 70.5 | 58.1 | 28 | −41 | 14.0 | 125 |
| 20 | 71.4 | 60.2 | 25 | −33 | 13.0 | 100 |
| 21 | 69.0 | 58.2 | 29 | −45 | 13.4 | 75 |
| 22 | 65.8 | 53.4 | 28 | −42 | 13.2 | 100 |
| 23 | 67.3 | 55.4 | 28 | −41 | 12.9 | 100 |
| 24 | 68.4 | 56.0 | 29 | −28 | 12.8 | 100 |
| 25 | 69.5 | 54.9 | 27 | −30 | 13.1 | 100 |
| 26 | 67.8 | 56.7 | 27 | −34 | 12.1 | 75 |
| 27 | 67.4 | 57.4 | 26 | −42 | 13.5 | 75 |
| 28 | 66.8 | 56.3 | 29 | −35 | 13.7 | 75 |
| 29 | 69.1 | 58.5 | 27 | −50 | 12.4 | 125 |
| 30 | 70.1 | 59.2 | 27 | −48 | 12.8 | 100 |
| 31 | 70.6 | 58.0 | 26 | −46 | 12.5 | 100 |

TABLE 2-continued

| No. | Tensile Test (Room temperature) Tensile Strength (kgf/mm²) | 0.2% Proof Strength (kgf/mm²) | Elongation (%) | Transition Temperature by Charpy Impact Test (°C.) | 600° C. × 10⁴ h Creep Rupture Strength (kgf/mm²) | Preheating Temperature for Preventing Weld Crack (°C.) |
|---|---|---|---|---|---|---|
| 32 | 71.3 | 61.4 | 26 | −37 | 13.2 | 75 |
| 33 | 72.4 | 60.8 | 27 | −40 | 11.8 | 125 |
| 34 | 73.6 | 61.7 | 28 | −35 | 11.9 | 125 |
| 35 | 70.5 | 57.1 | 27 | −30 | 13.5 | 100 |
| 36 | 69.4 | 56.6 | 26 | −42 | 14.8 | 100 |
| 37 | 72.2 | 60.5 | 25 | −37 | 15.1 | 125 |
| 38 | 71.5 | 61.2 | 27 | −40 | 15.3 | 125 |
| 39 | 73.3 | 62.1 | 28 | −38 | 15.4 | 100 |
| 40 | 70.9 | 58.3 | 26 | −38 | 14.9 | 125 |
| 41 | 69.2 | 57.1 | 25 | −40 | 14.3 | 100 |
| 42 | 69.6 | 56.9 | 23 | −39 | 14.1 | 100 |

*Slanting y-shaped restrain weld cracking test (JIS Z 3158).

What is claimed is:

1. A low-Cr ferritic steel with improved toughness as well as creep strength which consists essentially of, by weight %:

C: 0.03–0.12%, Si: 0.70% or less, Mn: 0.10–1.50%,
Ni: 2.0% or less, Cr: 1.50–3.50%, W: 1.0–3.0%,
V: 0.10–0.35%, Nb: 0.01–0.10%,
B: 0.00010–0.020%, N: 0.005% or less,
Al: 0.005% or less,
Ti: not less than 0.001% but less than 0.05%,
Cu: 0.10–2.50%,
at least one of La, Ce, Y, Ca, Zr, Ta each in an amount of 0–0.20%, and Mg in an amount of 0–0.05%,
Mo in an amount of 0–0.40%, and
a balance of Fe and incidental impurities including P: not more than 0.030% and S: not more than 0.015%.

2. A low-Cr ferritic steel as set forth in claim 1 including at least two of La, Ce, Y, Ca, Zr, Ta each in an amount of 0.01–0.20% and Mg in an amount of 0.0005–0.05%.

3. A low-Cr ferritic steel as set forth in claim 1 wherein

Mo is present in an amount of 0.01–0.40%.

4. A low-Cr ferritic steel as set forth in claim 1 wherein

C: 0.05–0.08%.

5. A low-Cr ferritic steel as set forth in claim 1 wherein

W: 1.4–1.8%.

6. A low-Cr ferritic steel as set forth in claim 1 wherein

Cu: 0.20–1.0%.

7. A low-Cr ferritic steel with improved toughness as well as creep strength which consists essentially of, by weight %:

C: 0.03–0.12%, Si: 0.70% or less, Mn: 0.10–1.50%,
Ni: 2.0% or less, Cr: 1.50–3.50%, W: 1.0–3.0%,
V: 0.10–0.35%, Nb: 0.01–0.10%,
B: 0.00010–0.020%, N: 0.005% or less,
Al: 0.005% or less,
Ti: not less than 0.001% but less than 0.05%,
Cu: 0.10–2.50%,
at least one of La, Ce, Y, Ca, Zr, Ta each in an amount of 0.01–0.20%, and Mg in an amount of 0.0005–0.05%,
Mo in an amount of 0–0.40%, and
a balance of Fe and incidental impurities including P: not more than 0.030% and S: not more than 0.015%.

8. A low-Cr ferritic steel as set forth in claim 7 wherein two or more of La, Ce, Y, Ca, Zr, Ta, and Mg in a total amount of not larger than 0.20%.

9. A low-Cr ferritic steel as set forth in claim 7 wherein

Mo is present in an amount of 0.01–0.40%.

10. A low-Cr ferritic steel as set forth in claim 7 wherein

C: 0.05–0.08%.

11. A low-Cr ferritic steel as set forth in claim 7 wherein

W: 1.4–1.8%.

12. A low-Cr ferritic steel as set forth in claim 7 wherein

Cu: 0.20–1.0%.

13. A low-Cr ferritic steel as set forth in claim 1, wherein

Mo: ≦0.10%.

14. A low-Cr ferritic steel as set forth in claim 1, wherein

Cu: ≧1.03%.

15. A low-Cr ferritic steel as set forth in claim 1, wherein

Ta: 0.01–0.2%.

16. A low-Cr ferritic steel as set forth in claim 1, wherein

Mg: 0.0005–0.05%.

17. A low-Cr ferritic steel as set forth in claim 1, wherein

Ca: 0.01–0.04%.

18. A low-Cr ferritic steel as set forth in claim 1, wherein the steel has a creep rapture strength at 600° C. after $10^4$ hours of at least 11.5 kgf/mm².

19. A low-Cr ferritic steel as set forth in claim 7, wherein

Mo: ≦0.10%.

20. A low-Cr ferritic steel as set forth in claim 7 wherein

Cu: ≧1.03%.

21. A low-Cr ferritic steel as set forth in claim 7, wherein

Ta: 0.01–0.2%.

22. A low-Cr ferritic steel as set forth in claim 7, wherein

Mg: 0.0005–0.05%.

23. A low-Cr ferritic steel as set forth in claim 7, wherein

Ca: 0.01–0.04%.

24. A low-Cr ferritic steel as set forth in claim 7, wherein the steel has a creep rapture strength at 600° C. after $10^4$ hours of at least 11.5 kgf/mm².

* * * * *